US011391461B2

(12) United States Patent
Ichihashi et al.

(10) Patent No.: US 11,391,461 B2
(45) Date of Patent: Jul. 19, 2022

(54) COMBUSTOR BULKHEAD WITH CIRCULAR IMPINGEMENT HOLE PATTERN

(71) Applicant: United Technologies Corporation, Farmington, CT (US)

(72) Inventors: Fumitaka Ichihashi, Unionville, CT (US); Albert K. Cheung, East Hampton, CT (US); Timothy S. Snyder, Glastonbury, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 228 days.

(21) Appl. No.: 16/736,340

(22) Filed: Jan. 7, 2020

(65) Prior Publication Data

US 2021/0207807 A1 Jul. 8, 2021

(51) Int. Cl.
*F23R 3/00* (2006.01)
*F23R 3/28* (2006.01)

(52) U.S. Cl.
CPC ..... *F23R 3/002* (2013.01); *F05D 2260/201* (2013.01); *F23R 3/283* (2013.01); *F23R 2900/03041* (2013.01); *F23R 2900/03044* (2013.01); *F23R 2900/03045* (2013.01)

(58) Field of Classification Search
CPC ..... F23R 3/002; F23R 3/283; F23R 2900/03041; F23R 2900/03044; F23R 3/04; F23R 3/10; F23R 2900/03045; F23R 3/007; F05D 2260/201
See application file for complete search history.

(56) References Cited

U.S. PATENT DOCUMENTS 5,129,231 A 7/1992 Becker
5,396,759 A * 3/1995 Richardson ..... F23R 3/10 60/804
5,509,270 A 4/1996 Pearce
5,623,827 A * 4/1997 Monty ..... F23R 3/10 60/747
5,941,076 A * 8/1999 Sandelis ..... F23R 3/26 60/752

(Continued)

OTHER PUBLICATIONS

EP search report for EP20150333.9 dated May 11, 2021.

*Primary Examiner* — Gerald L Sung
*Assistant Examiner* — Rene D Ford
(74) *Attorney, Agent, or Firm* — Getz Balich LLC

(57) ABSTRACT

A combustor for a gas turbine engine includes a combustion chamber defined between an inner shell and an outer shell. The combustor further includes a bulkhead extending between the inner shell and the outer shell. The bulkhead includes a plurality of impingement cooling rings. Each impingement cooling ring of the plurality of impingement cooling rings includes a plurality of impingement cooling holes extending through the bulkhead. The combustor further includes a heat shield panel mounted to the bulkhead so as to define an impingement cooling chamber between the bulkhead and the heat shield panel. The heat shield panel further includes a radial portion between a perimeter and an opening, with respect to an opening center axis, which is free of penetrations. The plurality of impingement cooling holes of each of the plurality of impingement cooling rings are directed toward the radial portion of the heat shield panel.

15 Claims, 9 Drawing Sheets

(56) References Cited

U.S. PATENT DOCUMENTS

| | | | | |
|---|---|---|---|---|
| 5,956,955 | A * | 9/1999 | Schmid | F23R 3/10 60/748 |
| 6,751,961 | B2 * | 6/2004 | Pacheco-Tougas | F23R 3/002 60/752 |
| 6,978,618 | B2 | 12/2005 | Pacheco-Tougas | |
| 7,260,936 | B2 | 8/2007 | Patel | |
| 7,506,512 | B2 | 3/2009 | Schumacher | |
| 7,509,813 | B2 | 3/2009 | Stastny | |
| 7,721,548 | B2 * | 5/2010 | Patel | F23R 3/10 60/752 |
| 7,730,725 | B2 * | 6/2010 | Faulder | F23R 3/002 60/752 |
| 7,748,221 | B2 * | 7/2010 | Patel | F23R 3/10 60/752 |
| 9,057,523 | B2 * | 6/2015 | Cunha | F23R 3/04 |
| 9,322,560 | B2 * | 4/2016 | Erbas-Sen | F23R 3/10 |
| 9,377,198 | B2 * | 6/2016 | Eastwood | F23R 3/44 |
| 9,557,060 | B2 * | 1/2017 | Papple | F23R 3/04 |
| 9,644,843 | B2 * | 5/2017 | Herborth | F23R 3/54 |
| 9,746,184 | B2 * | 8/2017 | Papple | F23R 3/10 |
| 10,247,419 | B2 | 4/2019 | Slavens | |
| 10,712,003 | B2 * | 7/2020 | Mulcaire | F23R 3/002 |
| 10,731,855 | B2 * | 8/2020 | Zelesky | F23R 3/002 |
| 2007/0180834 | A1 | 8/2007 | Caboche | |
| 2008/0115506 | A1 | 5/2008 | Patel | |
| 2008/0178599 | A1 * | 7/2008 | Hawie | F23R 3/10 60/752 |
| 2014/0102106 | A1 * | 4/2014 | Snyder | F23R 3/04 60/752 |
| 2016/0169516 | A1 * | 6/2016 | Low | F23R 3/06 60/782 |
| 2019/0072033 | A1 * | 3/2019 | Clum | F23R 3/002 |

* cited by examiner

COMBUSTOR BULKHEAD WITH CIRCULAR IMPINGEMENT HOLE PATTERN

BACKGROUND

1. Technical Field

This disclosure relates generally to combustors for gas turbine engines, and more particularly to cooling of heat shields for use in a combustor.

2. Background Information

Combustors, such as those used in gas turbine engines, may generally include radially spaced inner and outer shells which define a combustion chamber therebetween. A bulkhead may be provided at the forward end of the combustion chamber to shield a forward section of the combustor from the relatively high temperatures in the combustion chamber. A heat shield including one or more heat shield panels may be mounted on the bulkhead for further heat protection. Typically, relatively cool air from outside of the combustor is used to cool the bulkhead side of the heat shield panels. This cooling air may then be directed into the combustion chamber through effusion holes in the heat shield extending between the bulkhead side and the combustion chamber side.

However, in an attempt to improve flame anchoring within the combustor, modern heat shield panels may not contain large amounts of effusion holes. Due to the nature of hot gas recirculation near the heat shield, the lack of effusion cooling holes in the heat shield panels may result in significantly increased heat shield temperatures. This high-temperature effect on the heat shield can be particularly aggravated in proximity to low-flow cavity regions disposed between the heat shield and the combustor shells.

Impingement cooling holes have been used in bulkheads to direct cooling air so as to impinge on the heat shield panel, cooling the panel. Conventionally, impingement cooling hole density has been biased towards hot spots known to exist in the heat shield panels during operation of the combustor. However, such a configuration may result in non-uniform, and therefore sub-optimal, cooling flow between the bulkhead and heat shield panels as well as dead spots which can result in elevated temperatures as well as collections of dirt/debris which are not effectively removed by the cooling air. Accordingly, what is needed are improvements to heat shield panel cooling addressing one or more of the above-noted concerns.

SUMMARY

It should be understood that any or all of the features or embodiments described herein can be used or combined in any combination with each and every other feature or embodiment described herein unless expressly noted otherwise.

According to an embodiment of the present disclosure, a combustor for a gas turbine engine includes a combustion chamber defined between an inner shell and an outer shell. The combustor further includes a bulkhead extending between the inner shell and the outer shell. The bulkhead includes a plurality of impingement cooling rings. Each impingement cooling ring of the plurality of impingement cooling rings includes a plurality of impingement cooling holes extending through the bulkhead. The combustor further includes a heat shield panel including a first surface facing the combustion chamber and a second surface opposite the first surface and facing the bulkhead. The heat shield panel is mounted to the bulkhead so as to define an impingement cooling chamber between the bulkhead and the heat shield panel. The heat shield panel further includes a perimeter and an opening extending through the heat shield panel between the first surface and the second surface. The opening is centered about an opening center axis. The heat shield panel further includes a radial portion between the perimeter and the opening, with respect to the opening center axis, which is free of penetrations. The plurality of impingement cooling holes of each of the plurality of impingement cooling rings are directed toward the radial portion of the heat shield panel.

In the alternative or additionally thereto, in the foregoing embodiment, the plurality of impingement cooling rings are concentrically disposed about the opening center axis.

In the alternative or additionally thereto, in the foregoing embodiment, the plurality of impingement cooling rings are radially spaced such that a first radial distance between adjacent impingement cooling rings of the plurality of impingement cooling rings decreases as a second radial distance from the opening center axis increases.

In the alternative or additionally thereto, in the foregoing embodiment, a first plurality of impingement cooling holes of a first impingement cooling right of the plurality of impingement cooling rings is offset with respect to a second plurality of impingement cooling holes of an adjacent second impingement cooling ring of the plurality of impingement cooling rings.

In the alternative or additionally thereto, in the foregoing embodiment, the second impingement cooling ring is radially outside the first impingement cooling ring, with respect to the opening center axis, and the second plurality of impingement cooling holes includes a greater number of impingement cooling holes than the first plurality of impingement cooling holes.

In the alternative or additionally thereto, in the foregoing embodiment, the heat shield panel includes a first plurality of effusion holes extending through the heat shield panel and disposed radially between the radial portion and the opening with respect to the opening center axis.

In the alternative or additionally thereto, in the foregoing embodiment, the heat shield panel further includes a second plurality of effusion holes extending through the heat shield panel and disposed radially between the radial portion and the perimeter with respect to the opening center axis.

In the alternative or additionally thereto, in the foregoing embodiment, effusion holes of the first plurality of effusion holes have a greater diameter than effusion holes of the second plurality of effusion holes.

In the alternative or additionally thereto, in the foregoing embodiment, the radial portion has a first radial length in a direction between an inner diameter position of the opening and an outer diameter position of the perimeter which is greater than 70 percent of a second radial length between the inner diameter position of the opening and the outer diameter position of the perimeter.

In the alternative or additionally thereto, in the foregoing embodiment, each of the plurality of impingement cooling holes of the plurality of impingement cooling rings are oriented normal to a surface of the bulkhead facing the heat shield panel.

In the alternative or additionally thereto, in the foregoing embodiment, the radial portion of the heat shield panel includes a plurality of pin fins extending from the heat shield panel towards the bulkhead.

In the alternative or additionally thereto, in the foregoing embodiment, the plurality of pin fins has a pin fin height that is between 70 percent and 85 percent of a height of the impingement cooling chamber.

In the alternative or additionally thereto, in the foregoing embodiment, the plurality of impingement cooling rings includes at least five impingement cooling rings.

According to another embodiment of the present disclosure, a method for cooling a combustor heat shield panel of a gas turbine engine is disclosed. The method includes providing a bulkhead extending between an inner shell and an outer shell. The inner shell and the outer shell define a combustion chamber therebetween. The bulkhead includes a plurality of impingement cooling rings. Each impingement cooling ring includes a plurality of impingement cooling holes extending through the bulkhead. The method further includes providing a heat shield including a first surface facing the combustion chamber and a second surface opposite the first surface and facing the bulkhead. The heat shield panel mounted to the bulkhead so as to define an impingement cooling chamber between the bulkhead and the heat shield panel. The heat shield panel further including a perimeter and an opening extending through the heat shield panel between the first surface and the second surface. The opening centered about an opening center axis. The heat shield panel further including a radial portion between the perimeter and the opening, with respect to the opening center axis, which is free of penetrations. The method further includes directing an impingement cooling flow toward the radial portion of the heat shield panel with the plurality of impingement cooling holes of each of the plurality of impingement cooling rings.

In the alternative or additionally thereto, in the foregoing embodiment, the plurality of impingement cooling rings are concentrically disposed about the opening center axis.

In the alternative or additionally thereto, in the foregoing embodiment, the plurality of impingement cooling rings are radially spaced such that a first radial distance between adjacent impingement cooling rings of the plurality of impingement cooling rings decreases as a second radial distance from the opening center axis increases.

In the alternative or additionally thereto, in the foregoing embodiment, the method further includes directing a first effusion cooling flow with a first plurality of effusion holes extending through the heat shield panel and disposed radially between the radial portion and the opening with respect to the opening center axis and directing a second effusion cooling flow with a second plurality of effusion holes extending through the heat shield panel and disposed radially between the radial portion and the perimeter with respect to the opening center axis.

In the alternative or additionally thereto, in the foregoing embodiment, the radial portion of the heat shield panel includes a plurality of pin fins extending from the heat shield panel towards the bulkhead.

In the alternative or additionally thereto, in the foregoing embodiment, the plurality of pin fins has a pin fin height that is between 70 percent and 85 percent of a height of the impingement cooling chamber.

According to another embodiment of the present disclosure, a combustor for a gas turbine engine includes a combustion chamber defined between an inner shell and an outer shell. The combustor further includes a bulkhead extending between the inner shell and the outer shell. The bulkhead includes a plurality of impingement cooling rings. Each impingement cooling ring of the plurality of impingement cooling rings includes a plurality of impingement cooling holes extending through the bulkhead. The combustor further includes a heat shield panel including a first surface facing the combustion chamber and a second surface opposite the first surface and facing the bulkhead. The heat shield panel is mounted to the bulkhead so as to define an impingement cooling chamber between the bulkhead and the heat shield panel. The heat shield panel further includes a perimeter and an opening extending through the heat shield panel between the first surface and the second surface. The opening is centered about an opening center axis. The heat shield panel further including a radial portion between the perimeter and the opening, with respect to the opening center axis, which is free of penetrations. The radial portion of the heat shield panel including a plurality of pin fins extending from the heat shield panel towards the bulkhead. The plurality of impingement cooling rings are concentrically disposed about the opening center axis and radially spaced such that a first radial distance between adjacent impingement cooling rings of the plurality of impingement cooling rings decreases as a second radial distance from the opening center axis increases. A second impingement cooling ring of the plurality of impingement cooling rings, including a second plurality of impingement cooling holes, is radially outside a first impingement cooling ring of the plurality of impingement cooling rings, including a first plurality of impingement cooling holes, and the second plurality of impingement cooling holes includes a greater number of impingement cooling holes than the first plurality of impingement cooling holes. The plurality of impingement cooling holes of each of the plurality of impingement cooling rings are directed toward the radial portion of the heat shield panel.

The present disclosure, and all its aspects, embodiments and advantages associated therewith will become more readily apparent in view of the detailed description provided below, including the accompanying drawings.

DETAILED DESCRIPTION

Figure 1:
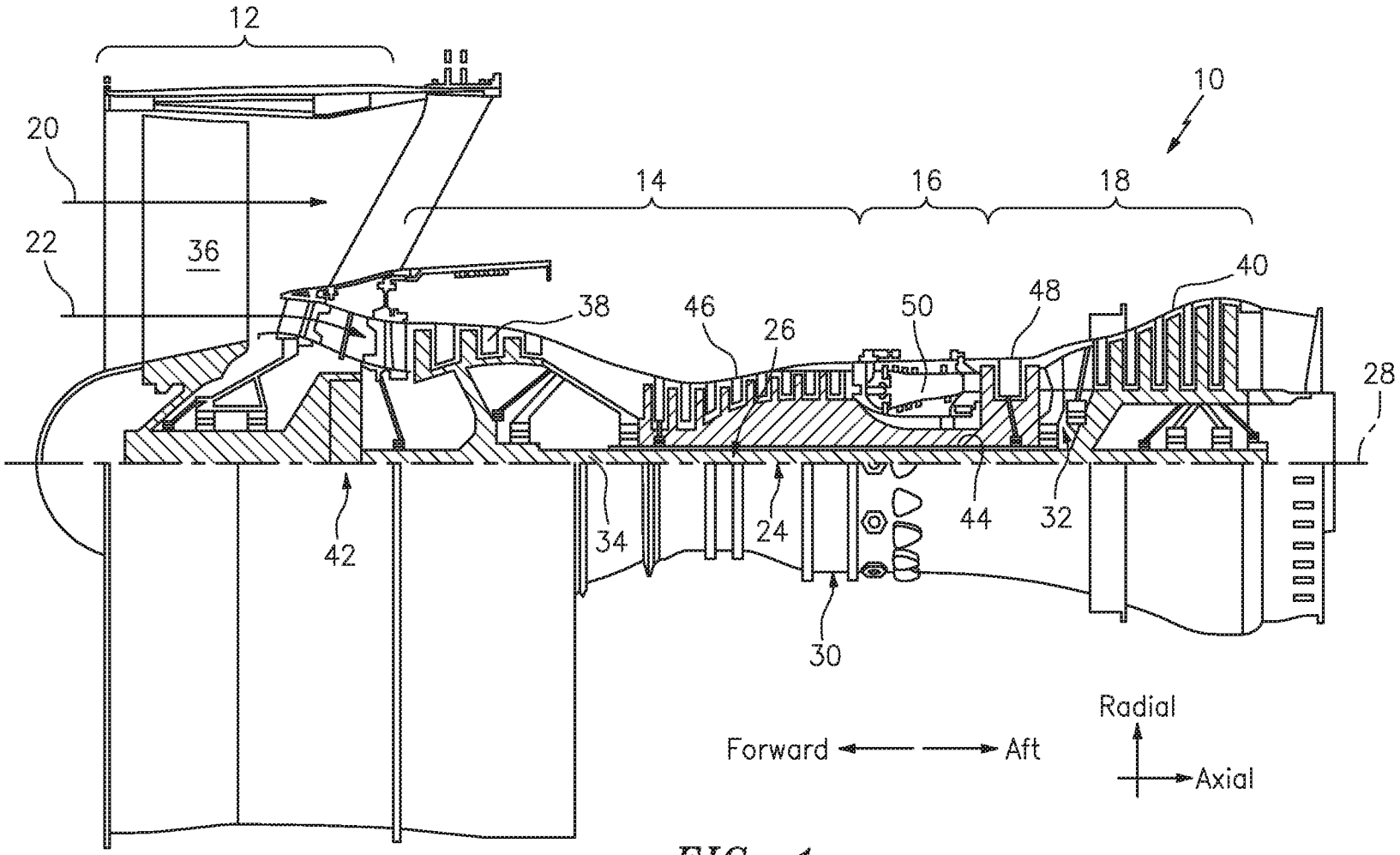
FIG. 1 illustrates a side cross-sectional view of a gas turbine engine in accordance with one or more embodiments of the present disclosure.

It is noted that various connections are set forth between elements in the following description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities. It is further noted that various method or process steps for embodiments of the present disclosure are described in the following description and drawings. The description may present the method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the description should not be construed as a limitation.

Referring to FIG. 1, an exemplary gas turbine engine 10 is schematically illustrated. The gas turbine engine 10 is disclosed herein as a two-spool turbofan engine that generally includes a fan section 12, a compressor section 14, a combustor section 16, and a turbine section 18. The fan section 12 drives air along a bypass flowpath 20 while the compressor section 14 drives air along a core flowpath 22 for compression and communication into the combustor section 16 and then expansion through the turbine section 18. Although depicted as a turbofan gas turbine engine in the disclosed non-limiting embodiments, it should be understood that the concepts described herein are not limited to use with turbofans as the teachings may be applied to other types of turbine engines including those with three-spool architectures.

The gas turbine engine 10 generally includes a low-pressure spool 24 and a high-pressure spool 26 mounted for rotation about a longitudinal centerline 28 of the gas turbine engine 10 relative to an engine static structure 30 via one or more bearing systems 32. It should be understood that various bearing systems 32 at various locations may alternatively or additionally be provided.

The low-pressure spool 24 generally includes a first shaft 34 that interconnects a fan 36, a low-pressure compressor 38, and a low-pressure turbine 40. The first shaft 34 may be connected to the fan 36 through a gear assembly of a fan drive gear system 42 to drive the fan 36 at a lower speed than the low-pressure spool 24. The high-pressure spool 26 generally includes a second shaft 44 that interconnects a high-pressure compressor 46 and a high-pressure turbine 48. It is to be understood that "low pressure" and "high pressure" or variations thereof as used herein are relative terms indicating that the high pressure is greater than the low pressure. An annular combustor 50 is disposed between the high-pressure compressor 46 and the high-pressure turbine 48 along the longitudinal centerline 28. The first shaft 34 and the second shaft 44 are concentric and rotate via the one or more bearing systems 32 about the longitudinal centerline 28 which is collinear with respective longitudinal centerlines of the first and second shafts 34, 44.

Airflow along the core flowpath 22 is compressed by the low-pressure compressor 38, then the high-pressure compressor 46, mixed and burned with fuel in the combustor 50, and then expanded over the high-pressure turbine 48 and the low-pressure turbine 40. The low-pressure turbine 40 and the high-pressure turbine 48 rotationally drive the low-pressure spool 24 and the high-pressure spool 26, respectively, in response to the expansion.

Figure 2:
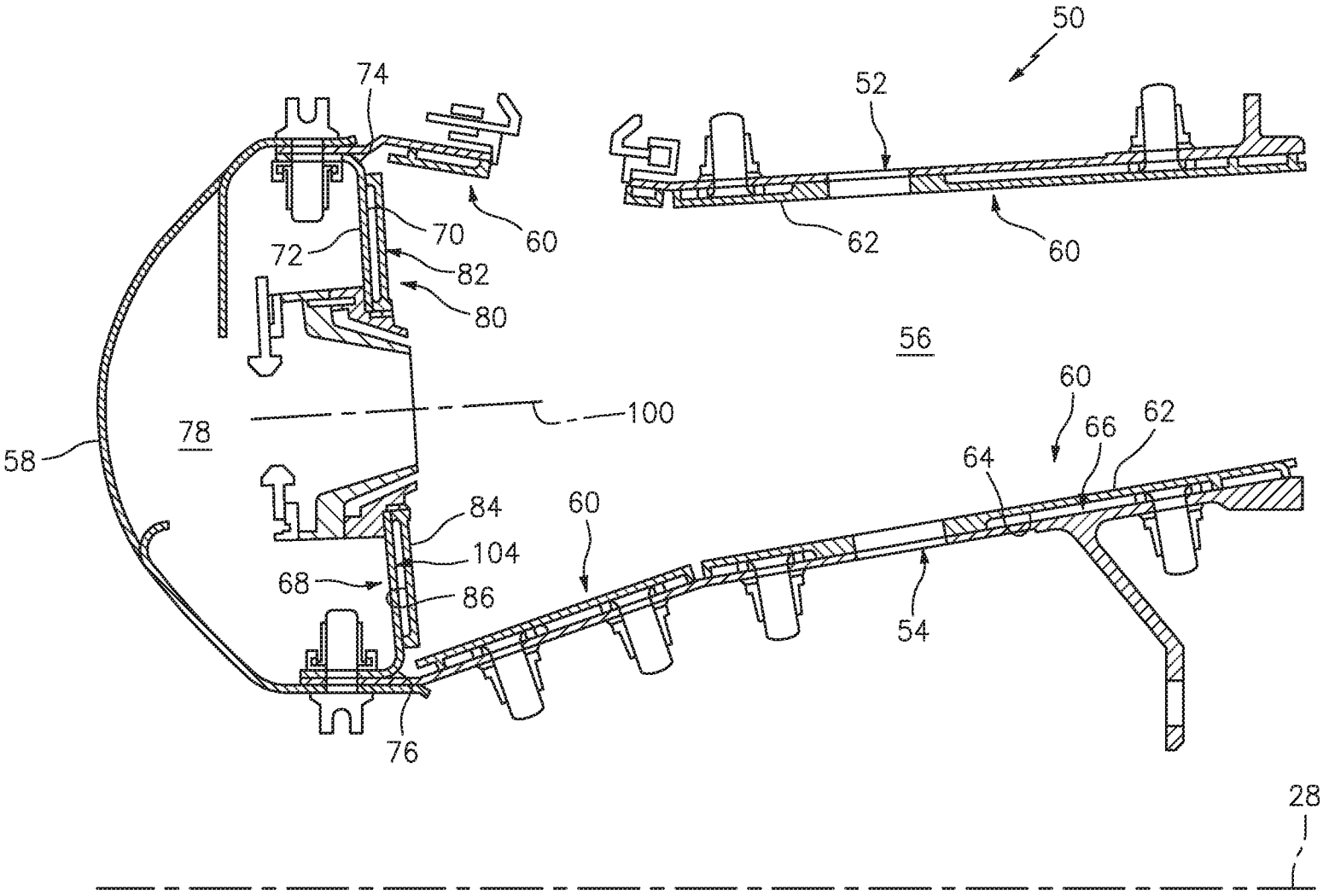
FIG. 2 illustrates a cross-sectional view of an exemplary combustor of a gas turbine engine in accordance with one or more embodiments of the present disclosure.
Figure 3:
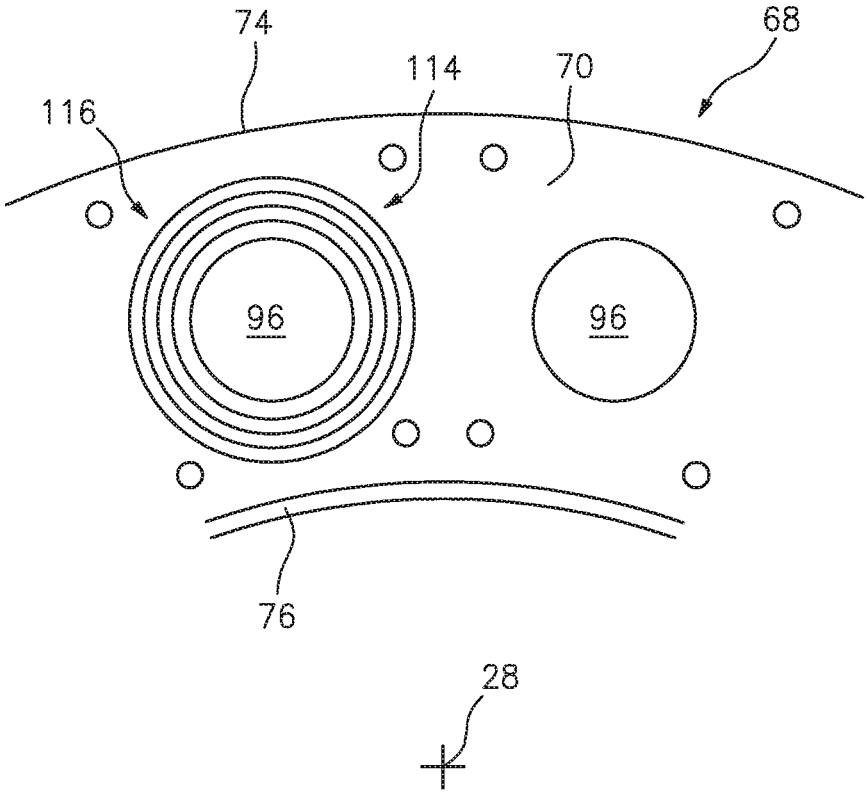
FIG. 3 illustrates a side view of a portion of a bulkhead of the combustor of FIG. 2 in accordance with one or more embodiments of the present disclosure.

Referring to FIG. 2, the combustor 50 includes an annular outer shell 52 and an annular inner shell 54 spaced radially inward of the outer shell 52, thus defining an annular combustion chamber 56 therebetween. An annular hood 58 is positioned axially forward of the outer shell 52 and the inner shell 54 and spans between and sealably connects to respective forward ends of the outer shell 52 and the inner shell 54. It should be understood that relative positional terms, such as "forward," "aft," "upper," "lower," "above," "below," and the like are relative to the normal operational attitude of the gas turbine engine 10 and should not be considered otherwise limiting.

The combustor 50 may include one or more liner panels 60 mounted to and spaced away from one or both of the outer shell 52 and the inner shell 54. The liner panel 60 may include a first surface 62 facing the combustion chamber 56 and a second surface 64 opposite the first surface 62. The second surface 64 of the liner panel 60 may be spaced from the respective shell 52, 54 so as to define a liner cooling chamber 66 therebetween.

Referring to FIGS. 2-8, the combustor 50 includes a bulkhead 68 having a first surface 70 facing the combustion chamber 56 and a second surface 72 opposite the first surface 70. The bulkhead 68 further includes an outer radial end 74 and an inner radial end 76 opposite the outer radial end 74. The bulkhead 68 may be connected to and extend between the outer shell 52 and the inner shell 54. For example, the bulkhead 68 may be connected to the outer shell 52 at the outer radial end 74 while the bulkhead 68 may be connected to the inner shell 54 at the inner radial end 76. The bulkhead 68 divides the combustion chamber 56 and a hood chamber 78 (i.e., the combustion chamber 56 is disposed downstream of the bulkhead 68 while the hood chamber 78 is disposed upstream of the bulkhead 68). The bulkhead 68 includes an annular heat shield 80 mounted to the first surface 70 of the bulkhead 68 and generally serving to thermally protect the bulkhead 68 and forward portions of the combustor 50, such as the hood chamber 78.

The heat shield 80 includes one or more heat shield panels 82. The heat shield panel 82 may include a first surface 84 facing the combustion chamber 56 and a second surface 86 opposite the first surface 84, an outer circumferential side 88 and an inner circumferential side 90 opposite the outer circumferential side 88, and a first radially extending side 92 and a second radially extending side 94 opposite the first radially extending side 92. Each of the first radially extending side 92 and the second radially extending side 94 may extend radially between the outer circumferential side 88 and the inner circumferential side 90. The outer circumferential side 88, the inner circumferential side 90, the first radially extending side 92, and the second radially extending side 94 form a perimeter of the heat shield panel 82.

The bulkhead 68 includes at least one opening 96 extending through bulkhead 68 between the combustion chamber 56 and the hood chamber 78. Each opening of the at least one opening 96 may accommodate a respective fuel injector (not shown) extending through the respective opening of the at least one opening 96 from the hood chamber 78 into the combustion chamber 56. The fuel injector may be configured to provide a mixture of fuel, air, and/or additional fluids for combustion in the combustion chamber 56. Similarly, the heat shield panel 82 may include an opening 98 corresponding to and aligned with a respective opening of the at least one opening 96 of the bulkhead 68. The opening 98 extends through the heat shield panel 82 between the first surface 84 and the second surface 86. The opening 98 of the heat shield panel 82 is centered about an opening center axis 100. In various embodiments, the respective opening of the at least one opening 96 of the bulkhead 68 may also be centered about the opening center axis 100.

The heat shield panel 82 may include a wall 102 extending from the second surface 86 of the heat shield panel 82 toward the bulkhead 68. The wall 102 may extend around all or a portion of the perimeter of the heat shield panel 82. All or a portion of the wall 102 may contact the first surface 70 of the bulkhead 68 and may form a seal between the bulkhead 68 and the heat shield panel 82. The first surface 70 of the bulkhead 68 and the second surface 86 of the heat shield panel 82 may defined an impingement cooling chamber 104 therebetween. The heat shield panel 82 may further include a wall 106 extending from the second surface 86 of the heat shield panel 82 toward the bulkhead 68 around all or a portion of the opening 98. All or a portion of the wall 106 may contact the first surface 70 of the bulkhead 68 and may form a seal between the bulkhead 68 and the heat shield panel 82 further defining the impingement cooling chamber 104.

In various embodiments, the heat shield panel 82 may include one or more rails 108 extending from the second surface 86 of the heat shield panel 82 toward the bulkhead 68. The one or more rails 108 may contact the first surface 70 of the bulkhead 68 and may form a seal between the bulkhead 68 and the heat shield panel 82. Accordingly, the one or more rails 108 may subdivide the impingement cooling chamber 104 into a plurality of impingement cooling chambers. The heat shield panel 82 may further include one or more studs 110 projecting from the second surface 86 of the heat shield panel 82 for mounting the heat shield panel 82 to the bulkhead 68.

Figure 6:
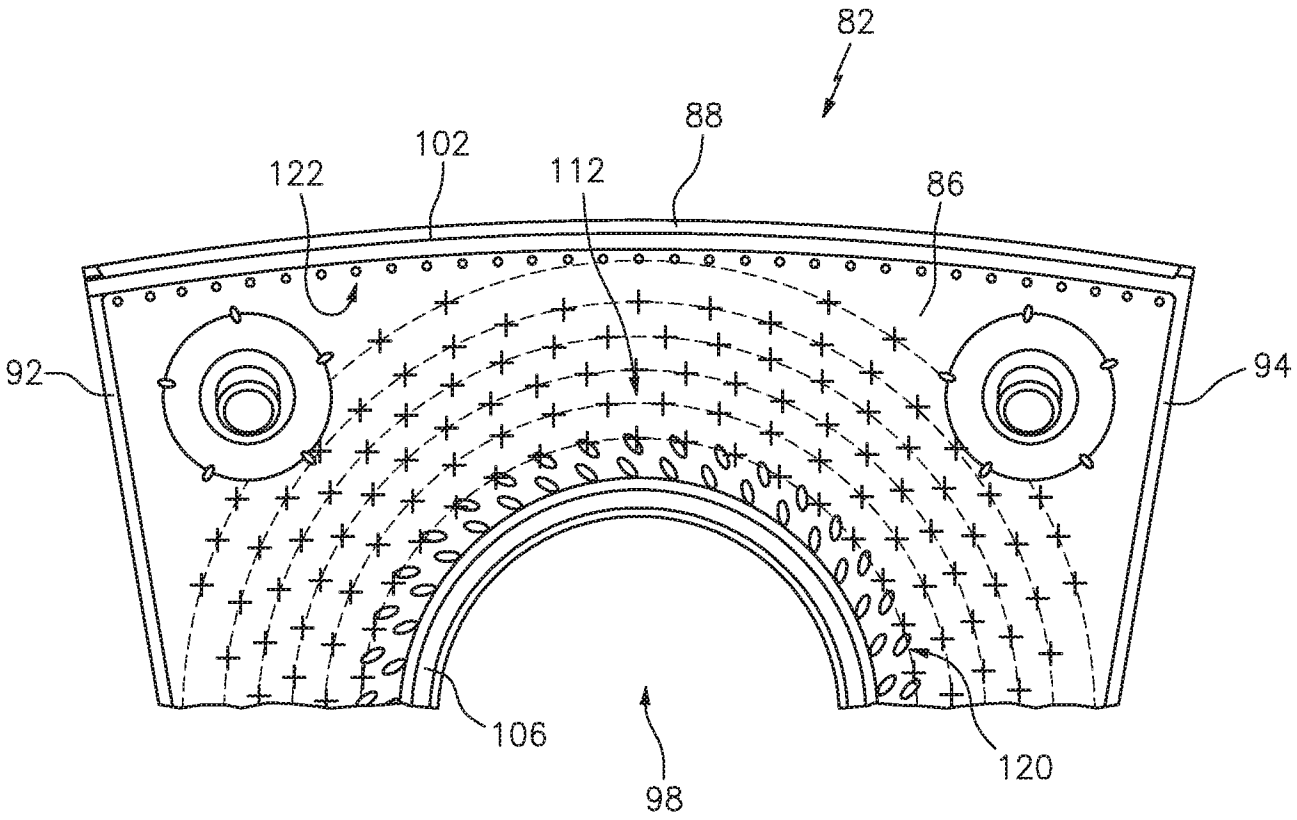
FIG. 6 illustrates a side view of the heat shield panel of FIG. 5 from a cold-side perspective in accordance with one or more embodiments of the present disclosure.

To cool the heat shield panel 74, an impingement cooling flow 112 of relatively cool air from outside the combustor 50 (e.g., from the hood chamber 78) is directed to the second surface 86 of the heat shield panel 82, thereby cooling the heat shield panel 82 (see, e.g., FIG. 6 illustrating the locations of impingement of the impingement cooling flow 112 on the second surface 86 of the heat shield panel 82). Accordingly, the bulkhead 68 of the present disclosure includes a plurality of impingement cooling rings 114 disposed about a respective opening of the at least one opening 96 of the bulkhead 68. Each impingement cooling ring of the plurality of impingement cooling rings 114 includes a plurality of impingement cooling holes 116 extending through the bulkhead 68 between the first surface 70 and the second surface 72. The plurality of impingement cooling holes 116 of the plurality of impingement cooling rings 114 may be oriented normal to the first surface 70 of the bulkhead 68 facing the heat shield panel 82. One or more of the at least one opening 96 of the bulkhead 68 may have a respective plurality of impingement cooling rings 114 disposed about the one or more of the at least one opening 96. In various embodiments, the bulkhead 68 may include impingement cooling holes which are not part of the impingement cooling rings of the plurality of impingement cooling rings 114. In various embodiments, the plurality of impingement cooling rings 114 may include at least five impingement cooling rings, however, a greater or lesser number of impingement cooling rings may be used.

The heat shield panel 82 includes a radial portion 118 of the heat shield panel 82 radially disposed between the perimeter of the heat shield panel 82 and the opening 98 with respect to the opening center axis 100. The radial portion 118 of the heat shield panel 82 is free of penetrations (e.g., cooling holes or other apertures extending through the heat shield panel 82 within the radial portion 118 of the heat shield panel 82). For example, the radial portion 118 of the heat shield panel 82 does not include effusion holes for cooling of the heat shield panel 82. The plurality of impingement cooling holes 116 of each of the plurality of impingement cooling rings 114 are directed toward the radial portion 118 of the heat shield panel 82 for impingement cooling thereof. Accordingly, the plurality of impingement cooling rings 114 may be radially aligned with the radial portion 118 of the heat shield panel 82 with respect to the opening center axis 100.

Figure 5:
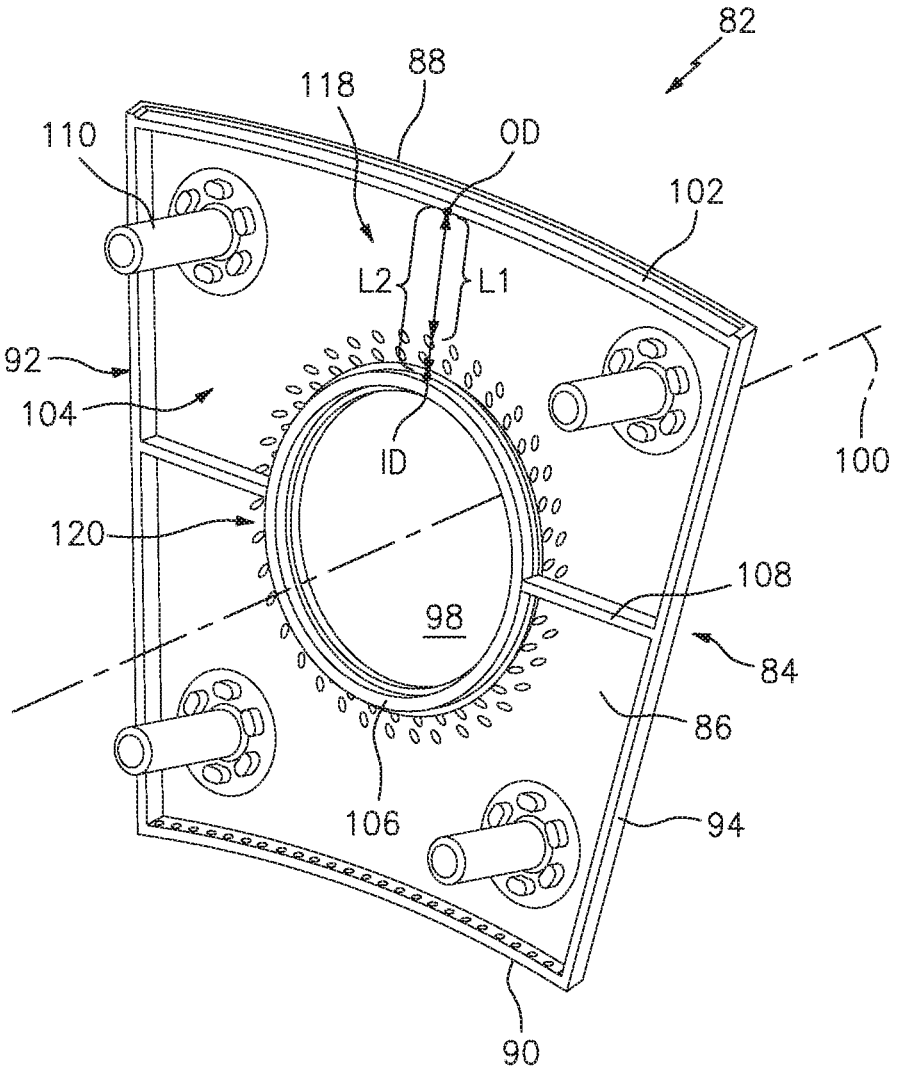
FIG. 5 illustrates a perspective view of a heat shield panel of the combustor of FIG. 2 in accordance with one or more embodiments of the present disclosure.

Referring to FIG. 5, in various embodiments, the radial portion 118 is a substantial portion of the radial extent of the heat shield panel 82. For example, the radial portion 118 may have a radial length L1 in a direction between an inner diameter position ID of the opening 98 and an outer diameter position OD of the perimeter of the heat shield panel 82 which is greater than 50 percent of a radial length L2 between the inner diameter position ID and the outer diameter position OD. In various other embodiments, the radial length L1 may be greater than 70 percent of the radial length L2. In various embodiments, the radial portion 118 may circumferentially encompass the opening 98 of the heat shield panel 82 (i.e., the radial portion 118 may be radially disposed between the opening 98 and the perimeter of the heat shield panel 82 about the entire circumference of the opening 98, with respect to the opening center axis 100).

Figure 4A:
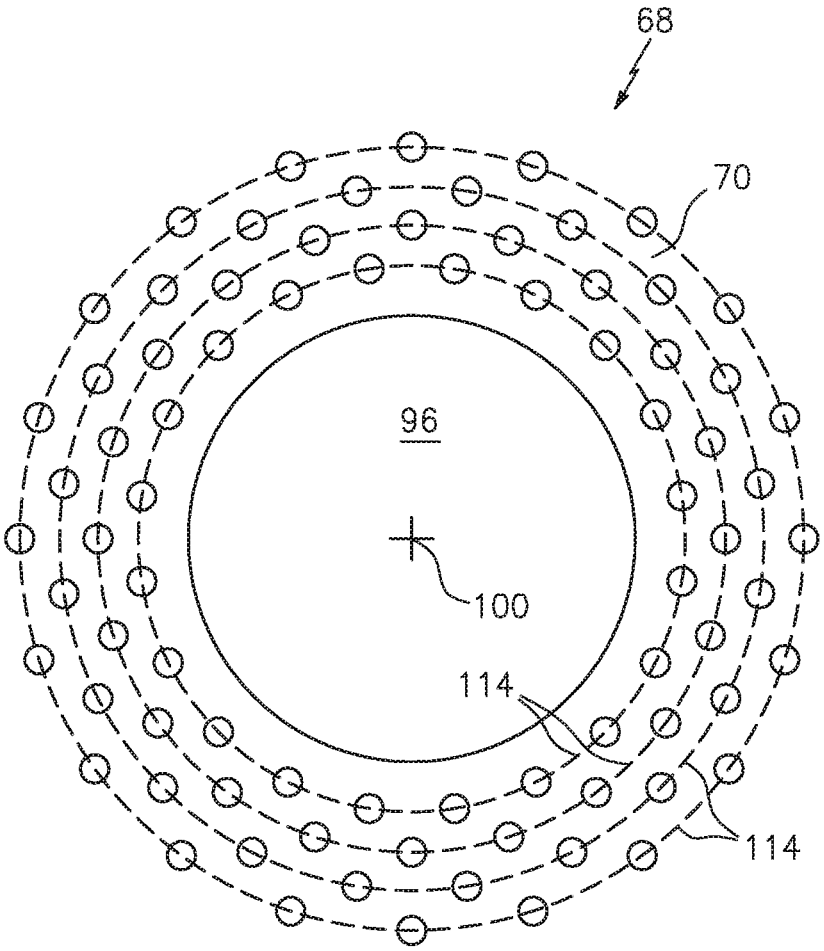
FIG. 4A illustrates a portion of the bulkhead of FIG. 3 in accordance with one or more embodiments of the present disclosure.
Figure 4B:
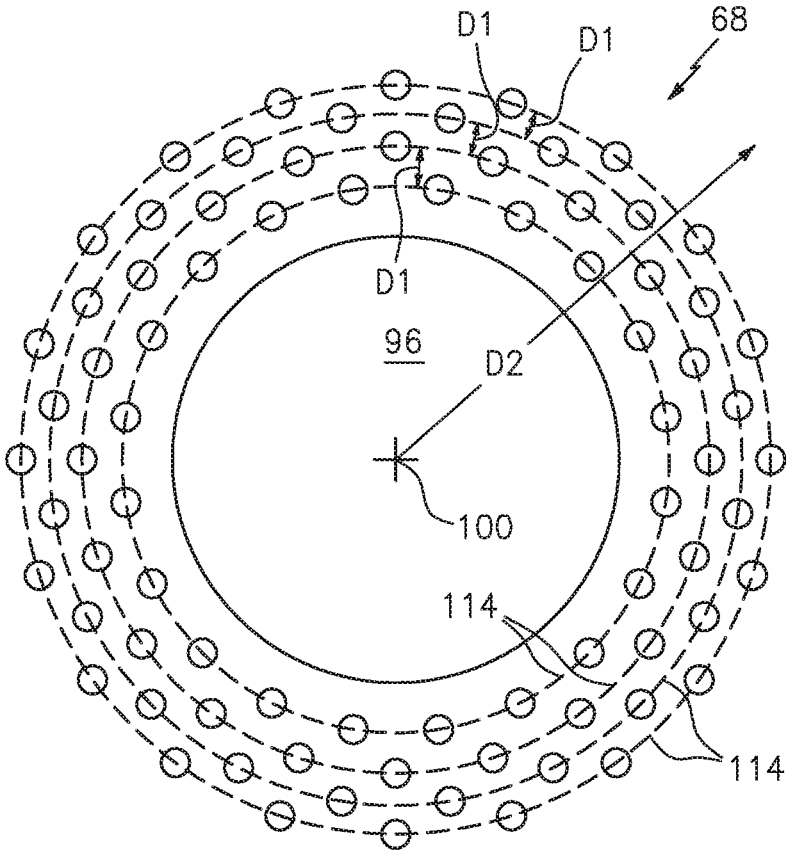
FIG. 4B illustrates a portion of the bulkhead of FIG. 3 in accordance with one or more embodiments of the present disclosure.

Referring to FIGS. 3-8, in various embodiments, the plurality of impingement cooling rings 114 may be concentrically disposed about the opening center axis 100 (see, e.g., FIGS. 4A and 4B). In various embodiments, the plurality of impingement cooling rings 114 may be radially spaced such that a radial distance D1 between adjacent impingement cooling rings of the plurality of impingement cooling rings 114 may decrease as a radial distance D2 from the opening center axis 100 increases (see, e.g., FIG. 4B). For example, adjacent impingement cooling rings of the plurality of impingement cooling rings 114 may progressively be located radially closer to one another as a distance from the opening 98 increases. As will be discussed in greater detail, this configuration of the plurality of impingement cooling rings 114 may provide a more constant backpressure of the impingement cooling air passing through the impingement cooling chamber 104 along the radial extent of the impingement cooling chamber 104. In various other embodiments, the plurality of impingement cooling rings 114 may have a constant radial spacing between adjacent impingement cooling rings of the plurality of impingement cooling rings 114 (see, e.g., FIG. 4A).

In various embodiments, for example, a first plurality of impingement cooling holes of a first impingement cooling ring of the plurality of impingement cooling rings 114 may be offset with respect to a second plurality of impingement cooling holes of an adjacent second impingement cooling ring of the plurality of impingement cooling rings 114. In other words, the plurality of impingement cooling holes of an impingement cooling ring may not be circumferentially aligned with the plurality of impingement cooling holes of an adjacent impingement cooling ring. This configuration of the plurality of impingement cooling rings 114 may reduce or eliminate the occurrence of dead spots within the impingement cooling chamber 104 (i.e., areas within the impingement cooling chamber 104 having reduced cooling flow) which may contribute to more uniform cooling flow as well as a reduction in dirt/debris accumulation within the impingement cooling chamber 104.

In various embodiments, the plurality of impingement cooling holes 116 of each impingement cooling ring of the plurality of impingement cooling rings 114 may include a different number of impingement cooling holes with respect to one or more other impingement cooling rings of the plurality of impingement cooling rings 114. In various embodiments, for example, a second plurality of impingement cooling holes of a second impingement cooling ring of the plurality of impingement cooling rings 114 may be disposed radially outside of a first plurality of impingement cooling holes of a first impingement cooling ring of the plurality of impingement cooling rings 114 with respect to the opening center axis 100. The second plurality of impingement cooling holes may include a greater number of impingement cooling holes than the first plurality of impingement cooling holes.

The heat shield panel may include effusion holes outside of the radial portion 118 of the heat shield panel 82. In various embodiments, the heat shield panel 82 may include a plurality of inner diameter effusion holes 120 extending through the heat shield panel 82 and disposed radially between the radial portion 118 and the opening 98 with respect to the opening center axis 100. In various embodiments, the heat shield panel 82 may alternatively or additionally include a plurality of outer diameter effusion holes 122 extending through the heat shield panel 82 and disposed radially between the radial portion 118 and the perimeter of the heat shield panel 82 with respect to the opening center axis 100. In various embodiments, the effusion holes of the plurality of inner diameter effusion holes 120 may have a greater diameter than the effusion holes of the plurality of outer diameter effusion holes 122. Accordingly, in various embodiments, a significantly greater amount of the impingement cooling flow 112 entering the impingement cooling chamber 104 may exit the impingement cooling chamber 104 via the plurality of inner diameter effusion holes 120 than the plurality of outer diameter effusion holes 122. As a result, cooling air flow within the impingement cooling chamber 104 may generally be in a direction from the perimeter of the heat shield panel 82 toward the plurality of inner diameter effusion holes 120.

Figure 7:
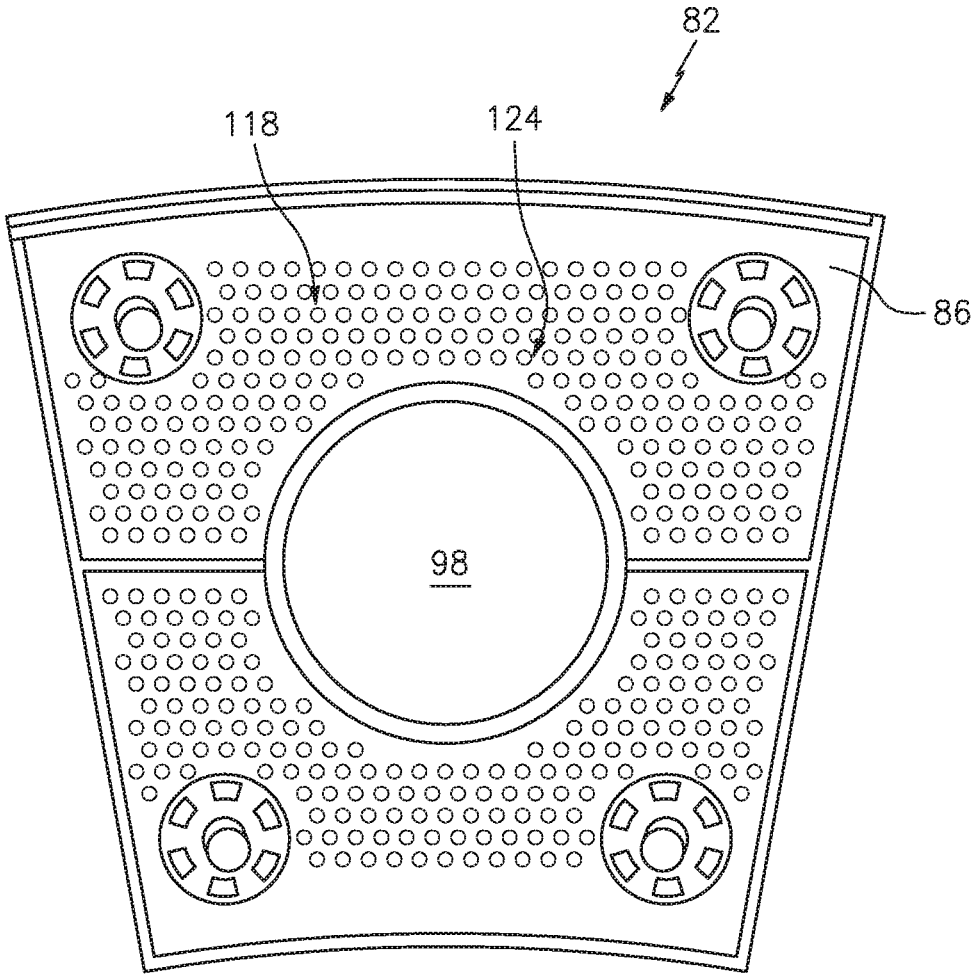
FIG. 7 illustrates another side view of the heat shield panel of FIG. 5 from a cold-side perspective in accordance with one or more embodiments of the present disclosure.
Figure 8:
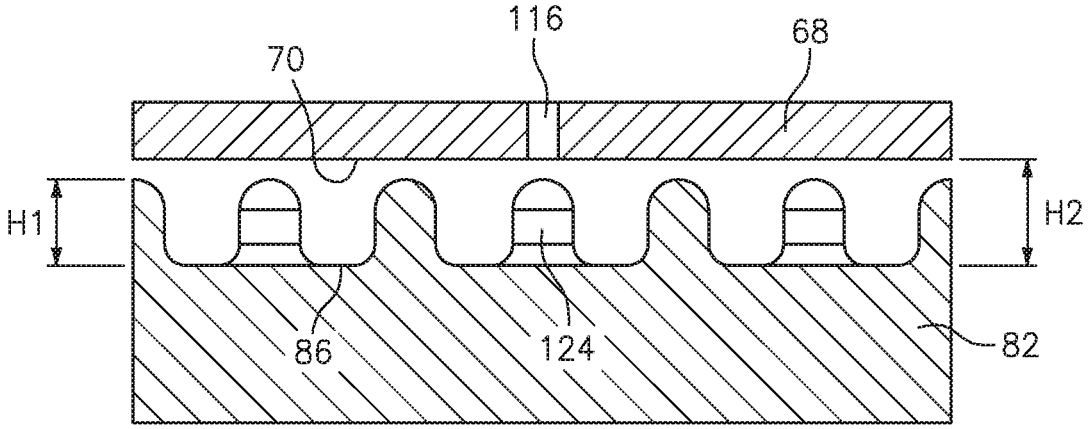
FIG. 8 illustrates a cross-sectional view of the heat shield panel of FIG. 7 in accordance with one or more embodiments of the present disclosure.

Referring to FIGS. 7 and 8, in various embodiments, the radial portion 118 of the heat shield panel 82 includes a plurality of pin fins 124 extending from the heat shield panel 82 towards the bulkhead 68. In various embodiments, the plurality of pin fins 124 has a pin fin height H1 that is between 70 percent and 85 percent of an impingement cooling chamber 104 height H2. In various other embodiments, the pin fin height H1 is between 75 percent and 80 percent of the impingement cooling chamber height H2. In various embodiments, the plurality of pin fins 124 may additionally extend from portions of the heat shield panel 82 outside of the radial portion 118.

Aspects of the present disclosure, such as the configuration of the plurality of impingement cooling rings 114 with respect to the radial portion 118 of the heat shield panel 82 may provide more uniform cooling of the heat shield 82, more uniform cross flow of cooling air within the impingement cooling chamber 104, as well as more uniform backpressure of the cooling air within the impingement cooling chamber 104. As a result, impingement cooling of the heat shield panel 82 may be improved while minimizing the accumulation of dirt/debris within the impingement cooling chamber 104.

While various aspects of the present disclosure have been disclosed, it will be apparent to those of ordinary skill in the art that many more embodiments and implementations are possible within the scope of the present disclosure. For example, the present disclosure as described herein includes several aspects and embodiments that include particular features. Although these particular features may be described individually, it is within the scope of the present disclosure that some or all of these features may be combined with any one of the aspects and remain within the scope of the present disclosure. References to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Accordingly, the present disclosure is not to be restricted except in light of the attached claims and their equivalents.

What is claimed is:

1. A combustor for a gas turbine engine, the combustor comprising:

a combustion chamber defined between an inner shell and an outer shell;

a bulkhead extending between the inner shell and the outer shell, the bulkhead comprising a plurality of impingement cooling rings, each impingement cooling ring of the plurality of impingement cooling rings comprising a plurality of impingement cooling holes extending through the bulkhead; and a heat shield panel comprising a first surface facing the combustion chamber and a second surface opposite the first surface and facing the bulkhead, the heat shield panel mounted to the bulkhead so as to define an impingement cooling chamber between the bulkhead and the heat shield panel, the heat shield panel further comprising a perimeter and an opening extending through the heat shield panel between the first surface and the second surface, the opening centered about an opening center axis, the heat shield panel further comprising a radial portion between the perimeter and the opening, with respect to the opening center axis, which is free of penetrations;

wherein the plurality of impingement cooling holes of each of the plurality of impingement cooling rings are directed toward the radial portion of the heat shield panel;

wherein the plurality of impingement cooling rings are concentrically disposed about the opening center axis; and wherein the plurality of impingement cooling rings are radially spaced such that a first radial distance between adjacent impingement cooling rings of the plurality of impingement cooling rings decreases as a second radial distance from the opening center axis increases.

2. The combustor of claim 1, wherein a first plurality of impingement cooling holes of a first impingement cooling ring of the plurality of impingement cooling rings is offset with respect to a second plurality of impingement cooling holes of an adjacent second impingement cooling ring of the plurality of impingement cooling rings.

3. The combustor of claim 1, wherein the heat shield panel comprises a first plurality of effusion holes extending through the heat shield panel and disposed radially between the radial portion and the opening with respect to the opening center axis.

4. The combustor of claim 3, wherein the heat shield panel further comprises a second plurality of effusion holes extending through the heat shield panel and disposed radially between the radial portion and the perimeter with respect to the opening center axis.

5. The combustor of claim 4, wherein effusion holes of the first plurality of effusion holes have a greater diameter than effusion holes of the second plurality of effusion holes.

6. The combustor of claim 5, wherein the radial portion has a first radial length in a direction between an inner diameter position of the opening and an outer diameter position of the perimeter which is greater than 70 percent of a second radial length between the inner diameter position of the opening and the outer diameter position of the perimeter.

7. The combustor of claim 1, wherein each of the plurality of impingement cooling holes of the plurality of impingement cooling rings are oriented normal to a surface of the bulkhead facing the heat shield panel.

8. The combustor of claim 1, wherein the radial portion of the heat shield panel comprises a plurality of pin fins extending from the heat shield panel towards the bulkhead.

9. The combustor of claim 8, wherein the plurality of pin fins has a pin fin height that is between 70 percent and 85 percent of a height of the impingement cooling chamber.

10. The combustor of claim 1, wherein the plurality of impingement cooling rings comprises at least five impingement cooling rings.

11. A method for cooling a combustor heat shield panel of a gas turbine engine, the method comprising:

providing a bulkhead extending between an inner shell and an outer shell, the inner shell and the outer shell defining a combustion chamber therebetween, the bulkhead comprising a plurality of impingement cooling rings, each impingement cooling ring comprising a plurality of impingement cooling holes extending through the bulkhead;

providing the heat shield panel comprising a first surface facing the combustion chamber and a second surface opposite the first surface and facing the bulkhead, the heat shield panel mounted to the bulkhead so as to define an impingement cooling chamber between the bulkhead and the heat shield panel, the heat shield panel further comprising a perimeter and an opening extending through the heat shield panel between the first surface and the second surface, the opening centered about an opening center axis, the heat shield panel further comprising a radial portion between the perimeter and the opening, with respect to the opening center axis, which is free of penetrations; and directing an impingement cooling flow toward the radial portion of the heat shield panel with the plurality of impingement cooling holes of each of the plurality of impingement cooling rings;

wherein the plurality of impingement cooling rings are concentrically disposed about the opening center axis; and wherein the plurality of impingement cooling rings are radially spaced such that a first radial distance between adjacent impingement cooling rings of the plurality of impingement cooling rings decreases as a second radial distance from the opening center axis increases.

12. The method of claim 11, further comprising:

directing a first effusion cooling flow with a first plurality of effusion holes extending through the heat shield panel and disposed radially between the radial portion and the opening with respect to the opening center axis; and directing a second effusion cooling flow with a second plurality of effusion holes extending through the heat shield panel and disposed radially between the radial portion and the perimeter with respect to the opening center axis.

13. The method of claim 12, wherein the radial portion of the heat shield panel comprises a plurality of pin fins extending from the heat shield panel towards the bulkhead.

14. The method of claim 13, wherein the plurality of pin fins has a pin fin height that is between 70 percent and 85 percent of a height of the impingement cooling chamber.

15. A combustor for a gas turbine engine, the combustor comprising:

a combustion chamber defined between an inner shell and an outer shell;

a bulkhead extending between the inner shell and the outer shell, the bulkhead comprising a plurality of impingement cooling rings, each impingement cooling ring of the plurality of impingement cooling rings comprising a plurality of impingement cooling holes extending through the bulkhead; and a heat shield panel comprising a first surface facing the combustion chamber and a second surface opposite the first surface and facing the bulkhead, the heat shield panel mounted to the bulkhead so as to define an impingement cooling chamber between the bulkhead and the heat shield panel, the heat shield panel further comprising a perimeter and an opening extending through the heat shield panel between the first surface and the second surface, the opening centered about an opening center axis, the heat shield panel further comprising a radial portion between the perimeter and the opening, with respect to the opening center axis, which is free of penetrations;

wherein the plurality of impingement cooling holes of each of the plurality of impingement cooling rings are directed toward the radial portion of the heat shield panel;

wherein the plurality of impingement cooling rings are concentrically disposed about the opening center axis;

wherein the heat shield panel comprises a first plurality of effusion holes extending through the heat shield panel and disposed radially between the radial portion and the opening with respect to the opening center axis wherein the heat shield panel further comprises a second plurality of effusion holes extending through the heat shield panel and disposed radially between the radial portion and the perimeter with respect to the opening center axis wherein effusion holes of the first plurality of effusion holes have a greater diameter than effusion holes of the second plurality of effusion holes.

* * * * *